United States Patent [19]

McGinnis

[11] Patent Number: 5,002,182

[45] Date of Patent: Mar. 26, 1991

[54] CRAYON HOLDER AND CONTAINER

[76] Inventor: Dale W. McGinnis, 866 Florence, Astoria, Oreg. 97103

[21] Appl. No.: 534,549

[22] Filed: Jun. 7, 1990

[51] Int. Cl.[5] ..... A45C 11/34; B43L 23/08

[52] U.S. Cl. ..... 206/214; 401/93; 206/224; 206/443; 30/451; 30/453; 144/28.1

[58] Field of Search ..... 211/69.1; 206/371, 443, 206/214; 401/93, 92, 94; 229/93; 30/451, 457, 453, 454, 462; 144/28.1, 28.11

[56] References Cited

U.S. PATENT DOCUMENTS

| | | | |
|---|---|---|---|
| 213,884 | 4/1879 | Faber | 401/93 |
| 629,586 | 7/1899 | McIntyre | 206/214 |
| 844,114 | 2/1907 | Foster | 206/214 |
| 1,704,772 | 3/1929 | Spikins | 401/93 |
| 1,838,556 | 12/1931 | Knorer | 229/8 |
| 2,190,942 | 2/1940 | Garvey | 401/93 |
| 2,438,895 | 4/1948 | Bouffard | 206/214 |
| 2,691,960 | 10/1954 | Leeds | 30/451 |
| 3,354,576 | 11/1967 | Gralnick | 206/457 |
| 4,573,571 | 3/1986 | Leem | 206/214 |

FOREIGN PATENT DOCUMENTS

| | | | |
|---|---|---|---|
| 413654 | 12/1966 | Switzerland | 401/93 |

*Primary Examiner*—Richard J. Johnson
*Attorney, Agent, or Firm*—Lee R. Schermerhorn

[57] ABSTRACT

Resilient fingers extend from one end of the crayon holder whereby a crayon may be pushed forward by a push rod to project beyond the fingers. A sleeve is slidable on the fingers to clamp the crayon in adjusted position, the sleeve being movable between outstanding flanges on the ends of the fingers and a shoulder on the holder at the opposite ends of the fingers. One form of container for a plurality of crayons in their individual holders has a push rod holder in the bottom of the container and a crayon sharpener mounted in a cover for the container. Another form of container has a push rod holder in the cover and no sharpener.

6 Claims, 2 Drawing Sheets

FIG. 1
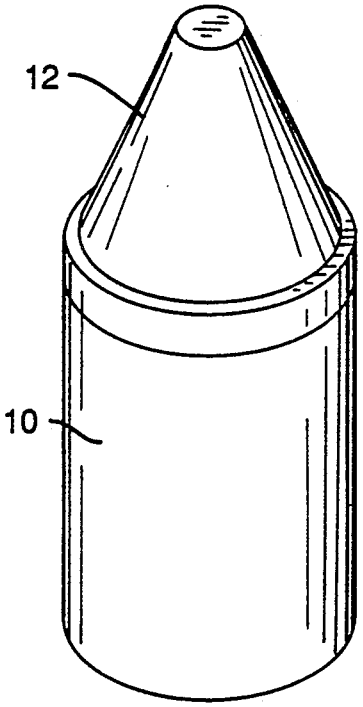
FIG. 2
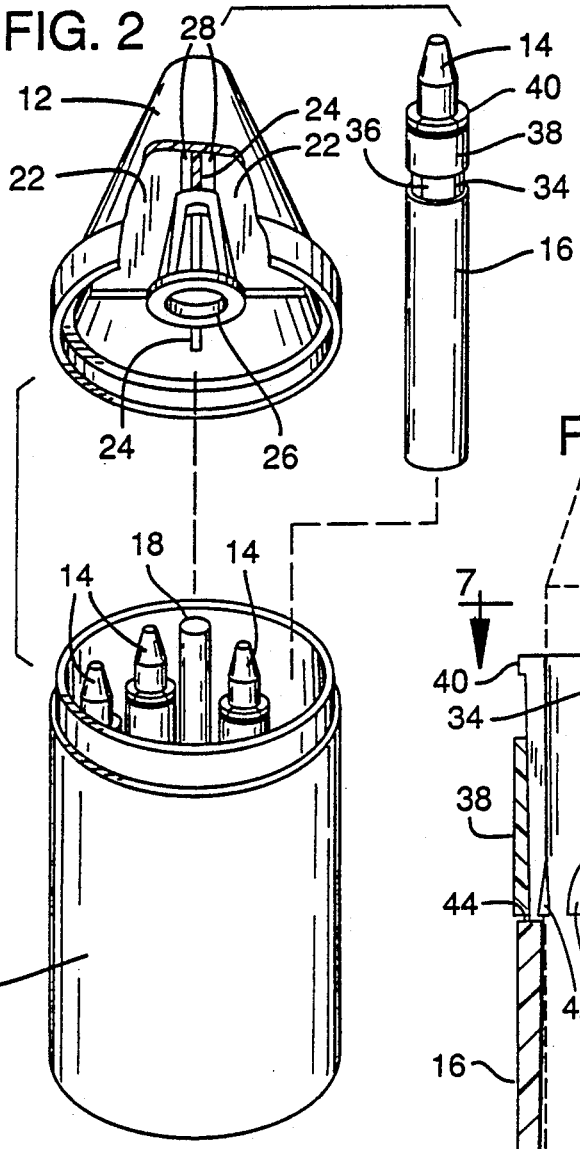
FIG. 6
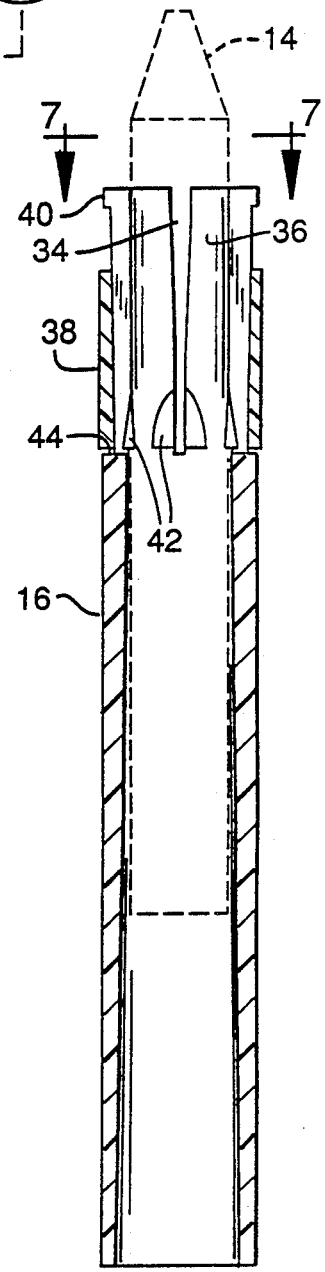
FIG. 3
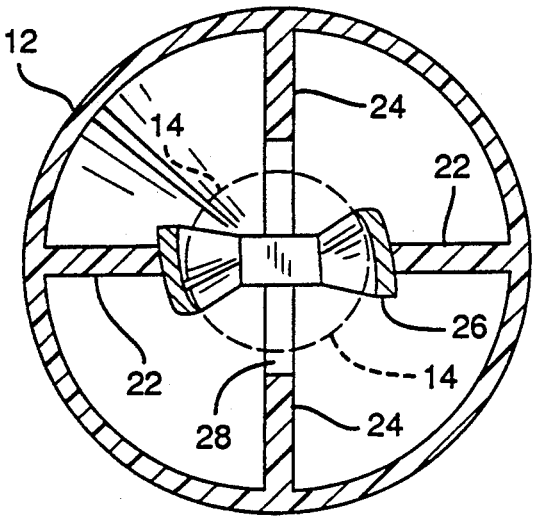
FIG. 7
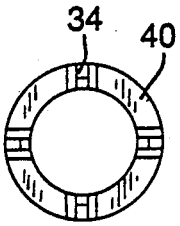
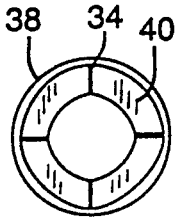
FIG. 8

CRAYON HOLDER AND CONTAINER

BACKGROUND OF THE INVENTION

This invention relates to improvements in an individual crayon holder for colored crayons used for marking on paper or for chalk sticks used on a blackboard, and to a container for a plurality of such crayons or chalk sticks in their individual holders.

Crayon holders heretofore proposed have been impractical because their complicated construction makes them too expensive to manufacture, and in many cases too difficult for a child to use.

There is a need for a crayon holder, to prevent breakage of the crayon, of a few simple parts which are inexpensive to manufacture and assemble and which can easily be used by young children. There is also a need for an attractive form of container of simple and inexpensive construction, for a plurality of crayons, which can be molded from plastic material.

SUMMARY OF THE INVENTION

The present crayon holder has only two parts which are preferably molded from plastic materials and which are readily assembled together. The holder allows for advancement of the crayon as it wears down and tightly grips a short end so that substantially the whole crayon may be used.

A container for a plurality of crayons in their holders is also preferably made of plastic materials wherein the container and a cover for the container may be molded in simple operations. The container is preferably cylindrical with a tapered cover to resemble a crayon itself, the material having a bright color which is attractive to children.

One form of container has a crayon sharpener in its cover arranged so that the shavings produced in sharpening a crayon are collected in the cover for convenient disposal. This container includes an upstanding push rod mounted in the center of the bottom of the container for advancing a crayon through its holder when the end of the crayon is worn down from use.

The other form of container has the push rod mounted in the cap, without a sharpener.

The invention will be better understood and additional features and advantages will become apparent from the following description of the preferred embodiments illustrated in the accompanying drawings. Various changes may be made in the details of construction and arrangement of parts and certain features may be used without others. All such modifications within the scope of the appended claims are included in the invention.

BRIEF DESCRIPTION OF THE DRAWINGS

FIG. 1 is a perspective view of a container for a plurality of crayons.

FIG. 2 is an exploded perspective view with parts broken away showing crayons in crayon holders in the container and a crayon sharpener in the cover.

FIG. 3 is a view on the line 3—3 in FIG. 4.

FIG. 6 is a longitudinal sectional view of a crayon holder showing the crayon in broken lines.

FIG. 7 is a view on the line 7—7 in FIG. 6 with the crayon gripping parts of the holder in retracted position.

FIG. 8 is a similar view showing the parts in gripping positions.

DESCRIPTION OF THE PREFERRED EMBODIMENTS

In FIGS. 1 and 2 the cylindrical container 10 has a tapered cover 12, both preferably molded from a plastic material having a bright color to resemble a large crayon and be attractive to children.

Figure 4:
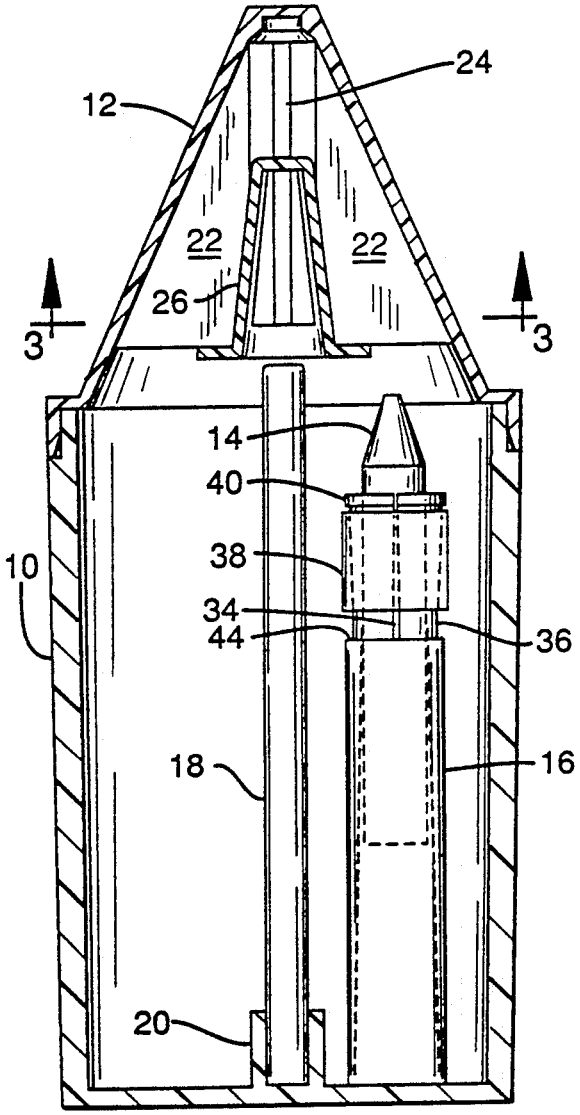
FIG. 4 is a longitudinal sectional view of the container in FIGS. 1-3 showing one crayon and crayon holder in the container.

A plurality of crayons 14 stand upright in the container, each in a crayon holder 16. In the center of the container is a push rod 18 mounted in a socket 20 in the bottom of the container as shown in FIG. 4. The push rod may be removed from this socket for pushing a crayon forward in its holder 16 as the end of the crayon becomes worn in use. If desired, the push rod may be used for this purpose without removing it from socket 20.

As seen in FIG. 3 the cover 12 contains radial vanes 22 and 24 mounting a crayon sharpener 26 in the cover. Portions of the vanes 24 are recessed at 28 to allow escape of shavings from sharpener 26 to fall into the cover when the cover is held in inverted position to provide a cup for the shavings. FIG. 4 shows further details of these parts. Cover 12 has a smooth frictional fit on container 10, also shown in FIG. 4.

Figure 5:
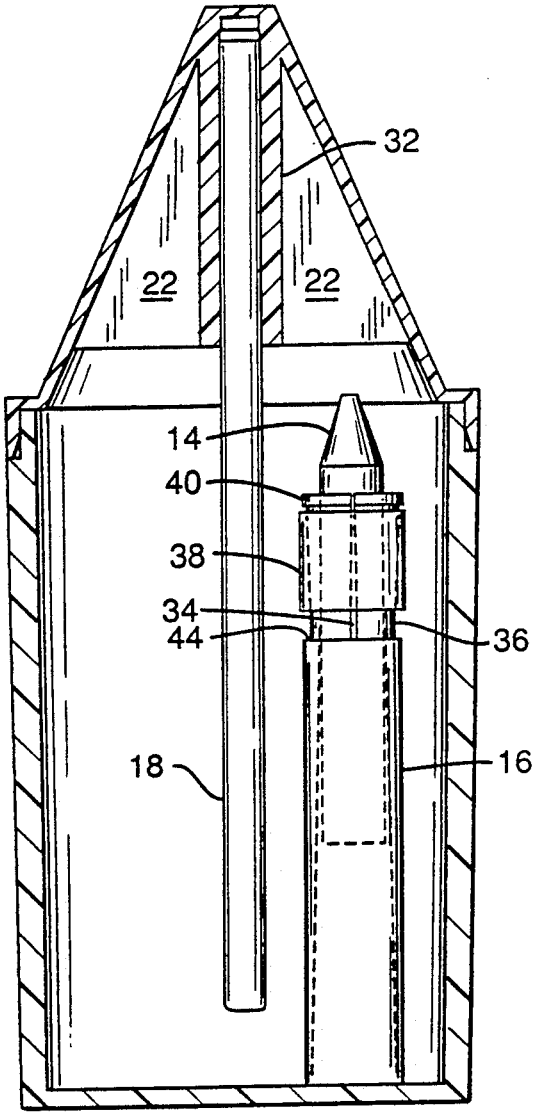
FIG. 5 is a similar view showing a modification having a push rod mounted in the cover instead of a crayon sharpener.

FIG. 5 shows a modification having a cover 30 wherein the vanes 22 and 24 are connected to a socket 32 to receive one end of push rod 18. The push rod may be permanently secured in such socket or it may be removable therefrom as desired.

FIGS. 6, 7 and 8 illustrate the details of the crayon holder 16. One end of the holder has four longitudinal slots 34 to form four fingers or jaws 36 which allow free movement of the crayon when pushed forward by push rod 18 with sleeve 38 in retracted position. When sleeve 38 is pushed forward toward flanges 40 on the fingers 36 the fingers are bent inward to grip even a short length of the crayon 14 securely in its adjusted position.

The thickness of fingers 36 increases toward their free ends so that sliding sleeve 38 toward the free ends clamps the fingers firmly against the crayon, the sleeve being retained by flanges 40. Slots 34 are wide enough to allow inward bending of the fingers in assembling the sleeve 38 over the flanges 40 in manufacture. Depressions 42 at the bases of the fingers increase flexibility at these hinge points. The reduced thickness of the fingers at their base ends provides a shoulder 44 to limit the retraction of the sleeve whereby the sleeve is retained on the holder.

Thus the crayon holder 16 contains only two parts which may be molded from plastic material and readily assembled at a low manufacturing cost.

What is claimed is:

1. A container for a plurality of crayons in individual crayon holders comprising a vertical cylindrical receptacle, an upstanding socket in the bottom of said receptacle to support a push rod, a conical cover for the receptacle, and a crayon sharpener mounted on radial vanes in said cover.

2. A container for a plurality of crayons in individual crayon holders comprising a vertical cylindrical receptacle, a conical cover for the receptacle, and a vertical socket mounted on radial vanes in said cover for supporting a push rod in the container.

3. A crayon holder comprising a tubular handle member to receive the crayon, longitudinal slots in one end of said tubular member forming resilient fingers overlying the crayon, a sleeve slidable on said fingers to clamp the fingers against the crayon, outstanding flanges on the free ends of said fingers to limit the outward movement of said sleeve, a shoulder on said tubular member at the opposite ends of said fingers to limit the retraction of said sleeve, said tubular member having an open end to receive a push rod for pushing the crayon forward when its marking end is worn away, a push rod, and a container for a plurality of said crayon holders, said push rod being mounted in a socket in the bottom of the container.

4. The combination of claim 3 including a cover for the container and a crayon sharpener mounted in said cover.

5. The combination of claim 4 including a plurality of radial vanes in said cover mounting said sharpener, said cover providing a collector for shavings from said sharpener.

6. A crayon holder comprising a tubular handle member to receive the crayon, longitudinal slots in one end of said tubular member forming resilient fingers overlying the crayon, a sleeve slidable on said fingers to clamp the fingers against the crayon, outstanding flanges on the free ends of said fingers to limit the outward movement of said sleeve, a shoulder on said tubular member at the opposite ends of said fingers to limit the retraction of said sleeve, said tubular member having an open end to receive a push rod for pushing the crayon forward when its marking end is worn away, a push rod, a container for a plurality of said crayon holders and a cover for the container, said push rod being mounted in a socket on a plurality of radial vanes in said cover.

* * * * *